US011193732B2

(12) United States Patent
Brun et al.

(10) Patent No.: US 11,193,732 B2
(45) Date of Patent: Dec. 7, 2021

(54) HOUSING INTENDED TO BE ARRANGED ON A VEHICLE AND WEAPON SYSTEM COMPRISING SUCH A HOUSING

(71) Applicant: NEXTER SYSTEMS, Roanne (FR)

(72) Inventors: Michel Brun, Bourges (FR); Virginie Vincent, Bourges (FR); Xavier Descatoire, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 236 days.

(21) Appl. No.: 16/483,135

(22) PCT Filed: Jan. 26, 2018

(86) PCT No.: PCT/FR2018/050186
§ 371 (c)(1),
(2) Date: Aug. 2, 2019

(87) PCT Pub. No.: WO2018/146395
PCT Pub. Date: Aug. 16, 2018

(65) Prior Publication Data

US 2020/0271414 A1 Aug. 27, 2020

(30) Foreign Application Priority Data

Feb. 7, 2017 (FR) ..... 1700137

(51) Int. Cl.
*F41F 3/042* (2006.01)
*F42B 39/20* (2006.01)

(52) U.S. Cl.
CPC ..... *F41F 3/042* (2013.01); *F42B 39/20* (2013.01)

(58) Field of Classification Search
CPC ..... F41F 3/042; F42B 39/20; F41H 7/04
See application file for complete search history.

(56) References Cited

U.S. PATENT DOCUMENTS

2006/0272231 A1 12/2006 Lajewski
2009/0073077 A1 3/2009 Reinheimer et al.
(Continued)

FOREIGN PATENT DOCUMENTS

DE 20 2014 003 420 U1 6/2014
FR 2 394 041 A1 1/1979
FR 3 026 479 A1 4/2016

OTHER PUBLICATIONS

Aug. 11, 2017 Preliminary Search Report issued in French Patent Application No. 1700137.
(Continued)

*Primary Examiner* — J. Woodrow Eldred
(74) *Attorney, Agent, or Firm* — Oliff PLC

(57) ABSTRACT

A housing intended to be arranged on a vehicle, in particular a military vehicle, and having a substantially parallelepiped shape including a front wall and a rear wall that each includes at least one bore for allowing air to flow inside the housing. At least one of the front or rear walls carries a plate, arranged outside the housing and at a distance from said wall, the housing further including at least one first slot allowing air to pass between the plate and the wall in question, and at least one second slot constituted by the gap between a lateral edge of the plate and said wall. The invention also concerns a weapon system including at least one missile launcher arranged in such a housing.

11 Claims, 5 Drawing Sheets

(56) References Cited

U.S. PATENT DOCUMENTS

| | | | | |
|---|---|---|---|---|
| 2012/0036987 | A1 | 2/2012 | Guruprasad et al. | |
| 2014/0011440 | A1 | 1/2014 | Savchenko et al. | |
| 2014/0174283 | A1 | 6/2014 | Kempas | |
| 2020/0408495 | A1 * | 12/2020 | Major | B65G 47/19 |

OTHER PUBLICATIONS

Aug. 11, 2017 Written Opinion issued in French Patent Application No. 1700137.

Apr. 10, 2018 Search Report issued in International Patent Application No. PCT/FR2018/050186.

Apr. 10, 2018 Written Opinion of the International Searching Authority issued in International Patent Application No. PCT/FR2018/050186.

* cited by examiner

HOUSING INTENDED TO BE ARRANGED ON A VEHICLE AND WEAPON SYSTEM COMPRISING SUCH A HOUSING

The technical field of the invention relates to that of the housings that are intended to be arranged on a vehicle, and in particular on a military vehicle.

It is common to provide a vehicle with a housing, for example a luggage compartment, making it possible to carry additional equipment.

The military vehicles are often provided with such housings which make it possible to carry equipment, provisions or weapons.

A specific housing is the one enclosing a weapon system, for example a missile launching system (these housings enclosing a gun or a missile are often called "POD" in the aeronautical sector).

As an example, patents FR3026479 and FR2394041 describe missile launching housings that are deployable.

The housings generally have a substantially parallelepiped shape comprising a front wall, a rear wall, a lower wall, an upper wall and two side walls.

Generally, the front and rear walls comprise at least one bore to allow air to flow inside the housing in order to reduce the temperature therein.

This venting need is particularly important when the housing encloses a weapon system, such as a missile. Indeed, such weapon system comprises electronic and pyrotechnic components which are sensitive to temperature.

The need for venting the interior of a housing is also important when the housing encloses electronic components or even provisions.

When venting is ensured by natural convection through openings, the problem is to prevent the penetration of fine particles, such as grains of sand, into the housing. Therefore, there are conflicting needs for facilitating the air flow while preventing the penetration of foreign bodies.

Unfortunately, the current solutions which implement fine-mesh gratings are not sufficient to prevent the penetration of sand. Furthermore, these gratings are likely to get clogged when the vehicle moves, thereby limiting the cooling performance for the interior of the housing.

Patent US2014/174283 also describes a container carrying a missile launching system. This container is a 20-foot standardized container of the ISO type, provided with an access door 6, but no particular venting means is described. Patent application US2009/0073077 also describes a device for installing an antenna on a wall of a container. The antenna is attached on an inner wall of the container and is inserted inside one of the venting holes carried by a wall of the container. The holes are covered by a housing which forms an inner cavity in front of the venting holes, the cavity being open at its inner part which comprises slots. As mentioned above, this grating-based closure is not sufficient to prevent the penetration of sand.

The invention aims to provide a housing making it possible to alleviate such disadvantages.

The housing according to the invention makes it possible, with a simple structure, to ensure that the interior of the housing is cooled by natural convection, while preventing the venting holes from getting clogged.

Thus, the invention relates to a housing intended to be arranged on a vehicle, in particular a military vehicle, and having a substantially parallelepiped shape comprising a front wall, a rear wall, a lower wall, an upper wall and two side walls, the front and rear walls each comprising at least one bore for allwing air to flow inside the housing, the housing being characterized in that at least one of the front or rear walls carries a plate which is arranged outside the housing and at a distance from said wall, the at least one bore of the wall in question being located at the vicinity of an upper edge of said wall, the housing further comprising at least one first slot allowing air to pass between the plate and the wall in question, the slot being located at the vicinity of a lower edge of said wall, the plate also having at least one second dimension that is less than that of said wall in question such that there is at least one second slot constituted by the gap between a lateral edge of the plate and said wall, the housing comprising at least one sheet metal closing the gap between the plate and the wall at an upper edge and at at least one lateral edge of the wall in question.

According to one embodiment, the one or more first slots are carried by the plate and provided at the vicinity of a lower edge of the plate.

According to another embodiment, the plate could have at least one first dimension that is less than that of the wall in question such that at least one first slot is constituted by the gap between a lower edge of the plate and said wall.

Advantageously, the sheet metal could extends, at least on an edge, beyond the plate so as to constitute a baffle.

Preferably, the sheet metal will not extend to the lower edge of the wall.

Advantageously, the plate could comprise a notch cutting a lower corner so as to create a dissymmetry in the plate.

The plate could be an armor steel plate.

According to a particular embodiment, the lower wall of the housing could carry at least one water discharge hole, a panel being arranged below the lower wall and at a distance from the at least one hole, the panel comprising a median part that is parallel to the lower wall and extended by two lateral wings which gradually move away with respect to the lower wall, from the median part.

According to a particular embodiment, the lower wall of the housing could carry at least one water discharge hole intended to be positioned in front of a surface of a recess of the vehicle, the housing comprising at its lower wall inclined planes on either side of the lower wall that carries the holes.

Furthermore, the housing could carry a panel arranged below the lower wall and at a distance from the holes, the panel extending below the inclined planes located on either side of the lower wall.

The invention also relates to a weapon system comprising at least one missile launcher arranged in such a housing.

The invention will be better understood upon reading the following description of particular embodiments, made with reference to the appended drawings in which:

FIG. 1*a* is a schematic partial view of a vehicle carrying a housing according to the invention;

FIG. 1*b* is a side view of the housing according to an embodiment of the invention;

FIGS. 2*a* and 2*b* are two views of the front part of a housing according to a first embodiment of the invention, FIG. 2*b* being a section along the plane whose mark AA is visible in FIG. 2*a;*

FIGS. 3*a* and 3*b* are two views of the front part of a housing according to a second embodiment of the invention, FIG. 3*b* being a section along the plane whose mark BB is visible in FIG. 3*a;*

Figure 1A:
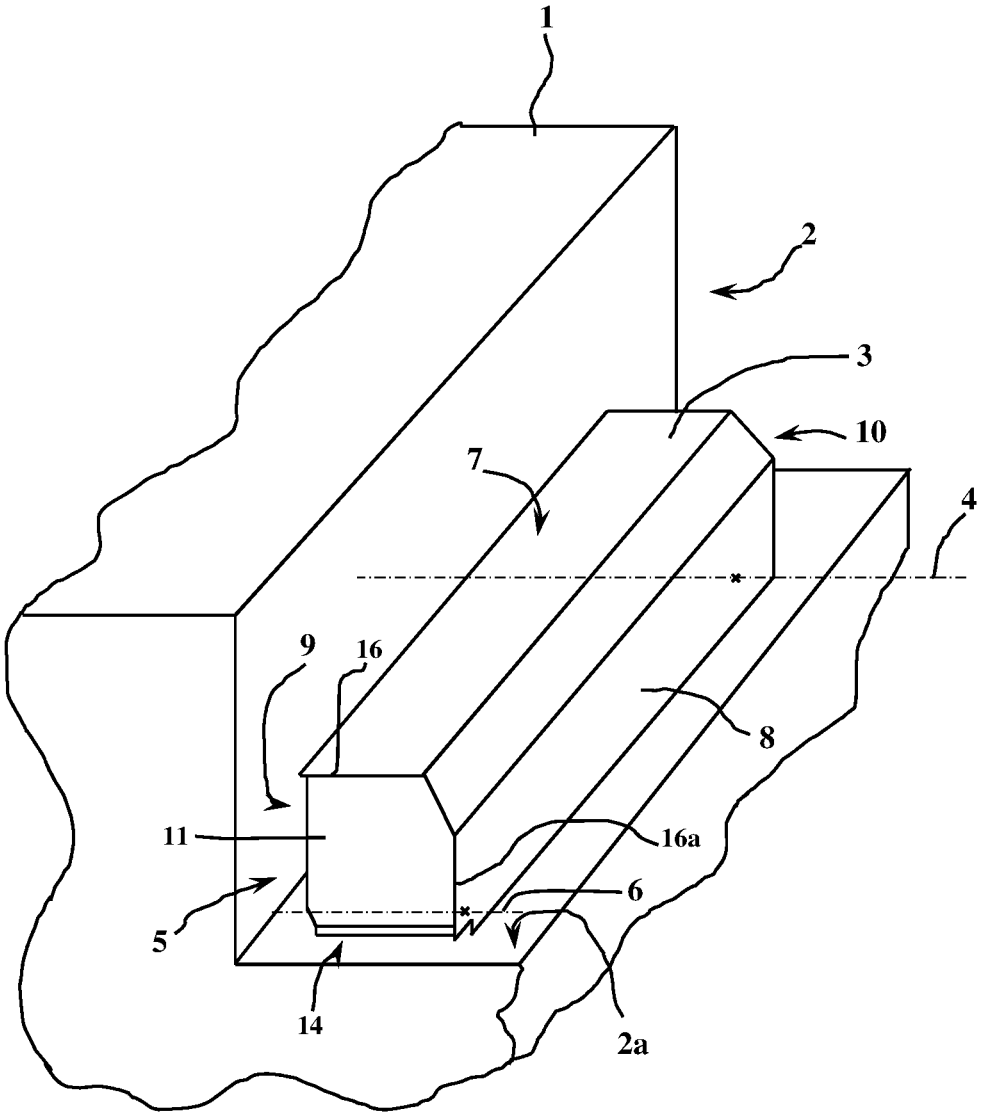

If referring to FIG. 1*a*, a vehicle 1 carries, at a recess 2, a housing 3 according to the invention.

The vehicle will be for instance an armored military vehicle provided with a turret and the recess 2 will be provided on the turret. The housing could be secured to the turret and in that case the horizontal part 2*a* of the recess 2 will simply match with the vehicle chassis. Then, the housing 3 will be arranged at a distance from the vehicle chassis.

The housing 3 could enclose a weapon system, such as a rocket or missile launcher.

This system is not shown in detail. It includes a plate carrying a launcher and in particular the housing 3 can be directed in elevation by pivoting around an aiming axis 4. Traverse is ensured by pivoting the turret itself.

Alternatively, the housing 3 can be fixed with respect to the turret. In that case, it is the weapon system arranged in the housing 3 that will be designed so as to be able to pivot around the aiming axis 4. This pivoting will be coupled to a means making it possible to open the roof 7 of the housing 3 in order to allow the weapon system to exit, with the housing 3 remaining fixed.

To enable firing, for instance firing of the missile, a front wall 5 of the housing is pivotally mounted with respect to the housing. The swiveling axis of the front wall 5 is shown by the chain-dotted line 6. Alternatively, as mentioned above, when the housing 3 is fixed and the roof 7 of the housing 3 opens to allow the weapon system to exit, the front wall 5 remains fixed.

All these structural members are not the subject-matter of the invention and therefore are not described in detail. Reference could be made to patent FR3026479 which describes an embodiment of a launching housing.

The housing 3 has a substantially parallelepiped shape and thus comprises a front wall 5, a rear wall 10, a lower wall (not visible in FIG. 1*a*), an upper wall 7 and two side walls 8 and 9.

The front 5 and rear 10 walls each comprise at least one bore to allow air to flow inside the housing 3. The air flows by forced convection, and it is the movement of the vehicle that ensures that the air flows by entering the housing 3 at the front wall 5 and exiting at the rear door 10.

Figure 1B:
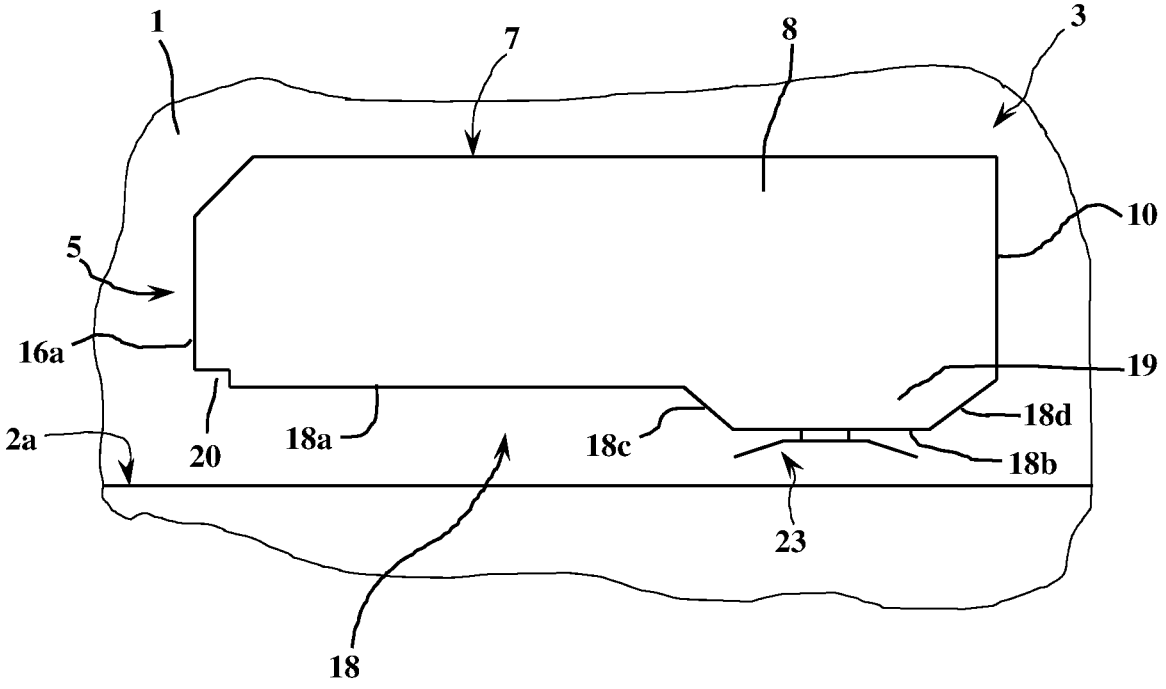

FIG. 1*b* shows a side view of the housing 3. It can be noted that the housing 3 comprises a lower wall 18 which is not planar but rather comprises a front part 18*a* and a rear part 18*b* that are substantially parallel and separated by a front connecting plane 18*c*. This configuration realises a rear box 19 which in particular makes it possible to accommodate the motorization means for deploying the housing 3 enclosing the weapon system. A rear inclined plane 18*d* connects the rear part 18*b* of the lower wall to the rear wall 10.

Figure 2A:
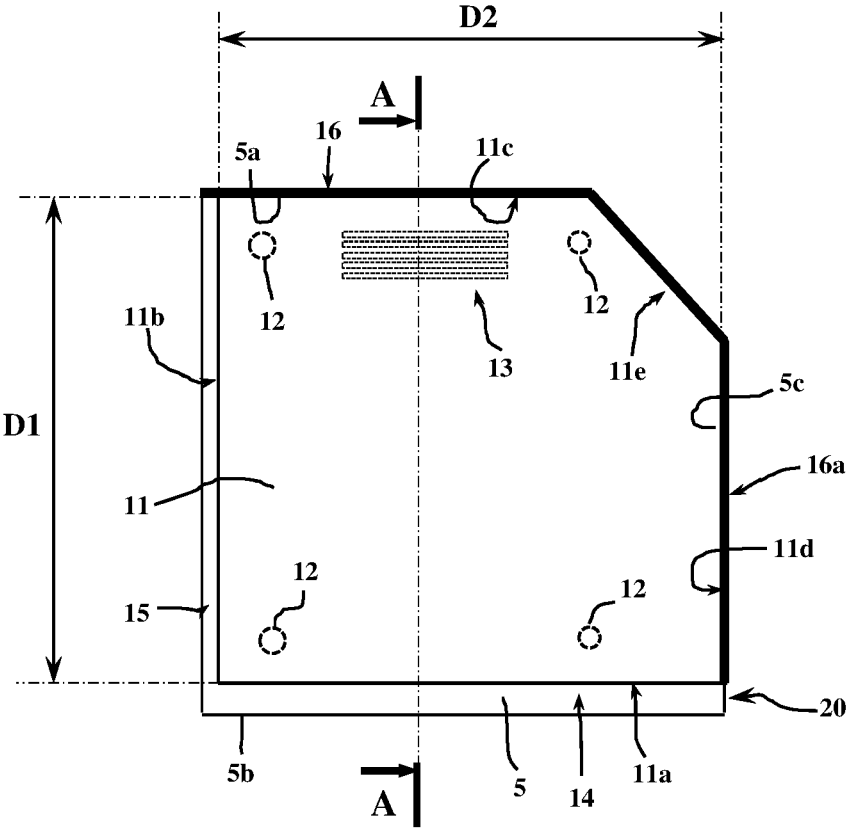
Figure 2B:
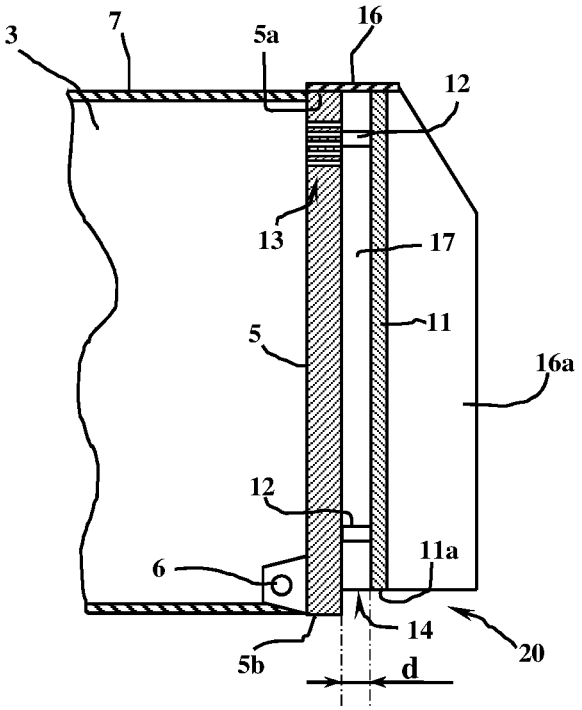

FIGS. 2*a* and 2*b* show a first embodiment of the front part of the housing 3.

As it can be particularly seen in FIG. 2*b*, the front wall 5 carries a plate 11 which is arranged outside the housing 3 and at a distance d from the front wall 5.

The plate 11 is attached at a distance from the front wall 5 via spacers 12 (here, four cylindrical spacers). The plate 11 is screwed on the spacers 12 which are themselves screwed or welded to the wall 5.

It can be seen in the figures that the wall 5 carries bores 13 which are here constituted by five grooves 13 provided in the wall 5. These grooves are shown in dotted lines in FIG. 2*a* because they are hidden by the plate 11.

The grooves 13 are located at the vicinity of an upper edge 5*a* of the front wall 5.

Of course, the grooves 13 could be replaced with a set of cylindrical bores.

Furthermore, the housing 3 comprises a first slot 14 allowing air to flow between the plate 11 and the wall 5.

This first slot 14 is located at the vicinity of a lower edge 5*b* of the front wall 5.

As it can be seen in FIG. 2*a*, the plate 11 has a first dimension D1 which is less than the respective dimension of the front wall 5. Thus, the first slot 14 is constituted by the gap between a lower edge 11*a* of the plate 11 and said front wall 5.

As it can also be seen in FIG. 2*a*, the plate 11 has a second dimension D2 which is less than the respective dimension of the front wall 5. Thus, there is a second slot 15 which is constituted by the gap between a lateral edge 11*b* of the plate 11 and the front wall 5.

The housing 3 also comprises a sheet metal 16 which closes the gap 17 between the plate 11 and the front wall 5 at the upper edge 5*a* of the front wall 5.

This sheet metal 16 also extends along a lateral edge 5*c* of the front wall 5 and also closes at this emplacement the gap 17 separating the plate 11 and the wall 5. As it can be seen in FIG. 2*b*, the sheet metal 16 does not extend beyond the lower edge 11*a* of the plate 11.

Thus, the sheet metal 16 does not extend to the lower edge 5*b* of the wall 5. This results in a lateral slot 20.

The sheet metal 16 is extended at least at one of its edges, beyond the plate 11, so as to constitute a baffle 16*a*.

Thus, the sheet metal 16 covers two sides of the plate 11, and it also covers, in the example shown, the cut corner 11*e* separating the edges 11*c* and 11*d* of the plate 11.

The operation of this assembly is as follows.

When the vehicles moves, air enters through the first slot 14 between the plate 11 and the front wall 5. The sheet metal 16 prevents the discharge of air which has to flow towards the grooves 13 carried by the front wall 5. The air enters inside the housing 3 through these grooves 13. The progression of the sand that would be carried to the front wall 5 with the air flow is hindered due to its own mass. It cannot penetrate through the grooves 13. The sand falls by gravity and is discharged through the slot 20.

The excess air is discharged through the second slot 15 which also partially allows the sand to be discharged outwards and prevents the gap 17 from getting clogged.

The profile of the baffle 16*a* ensures a lateral protection of the plate 11 and channels the incident air flow.

The rear wall of the housing 3 could be equipped with a similar plate 11 mounting. It is not necessary to describe such an arrangement, the figures described and associated with a front wall can be transposed to a rear wall. However, this mounting is not essential, the venting movement taking place preferably from the front to the rear of the housing 3.

However, the plate 11 must necessarily be installed at the wall located forwards in the normal advance direction of the vehicle.

Furthermore, the plate 11 will advantageously be made of armor steel. It will then participate to the protection of the housing 3 against firing of automatic weapons. The front wall 5 could be made of a lightweight alloy, for example aluminum.

Figure 3A:
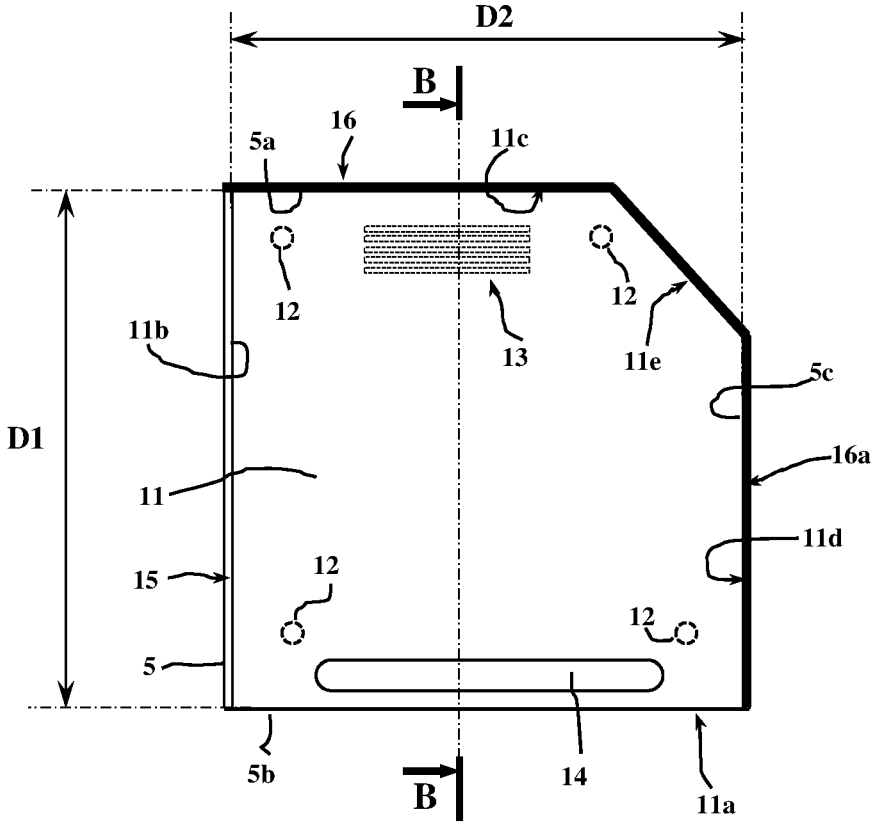
Figure 3B:
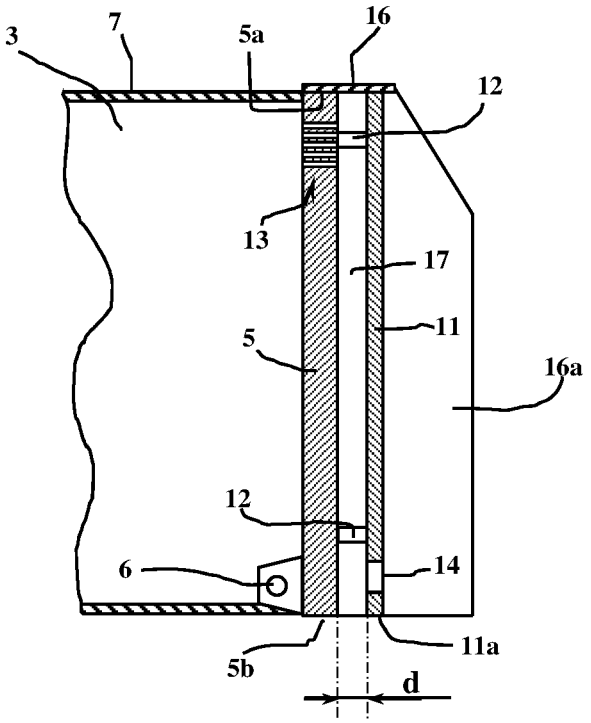

FIGS. 3*a* and 3*b* show a second embodiment of the invention.

This embodiment differs from the preceding one in the dimensions of the plate 11 and the shape of the first slot 14.

In this embodiment, the first slot 14 is a simple lumen parallel to the lower edge 11*a* of the plate and that is directly drilled in the plate 11. This plate 11 has a length D1 which is thus substantially equal to the respective dimension of the front wall 5.

Here, as in the preceding embodiment, the plate 11 has a second dimension D2 which is less than the respective dimension of the front wall 5. Therefore, there is still a second slot 15 which is constituted by the gap between a lateral edge 11*b* of the plate and the front wall 5.

This second slot could be omitted, but it is essential that the gap separating the housing 3 from the wall 2*a* of the recess 2 be large enough to make the lateral discharge of excess air and sand possible.

This embodiment makes it possible to increase the surface of the front wall 5 that is covered by the plate 11, and thus the protection of the housing against firing.

Figure 4:
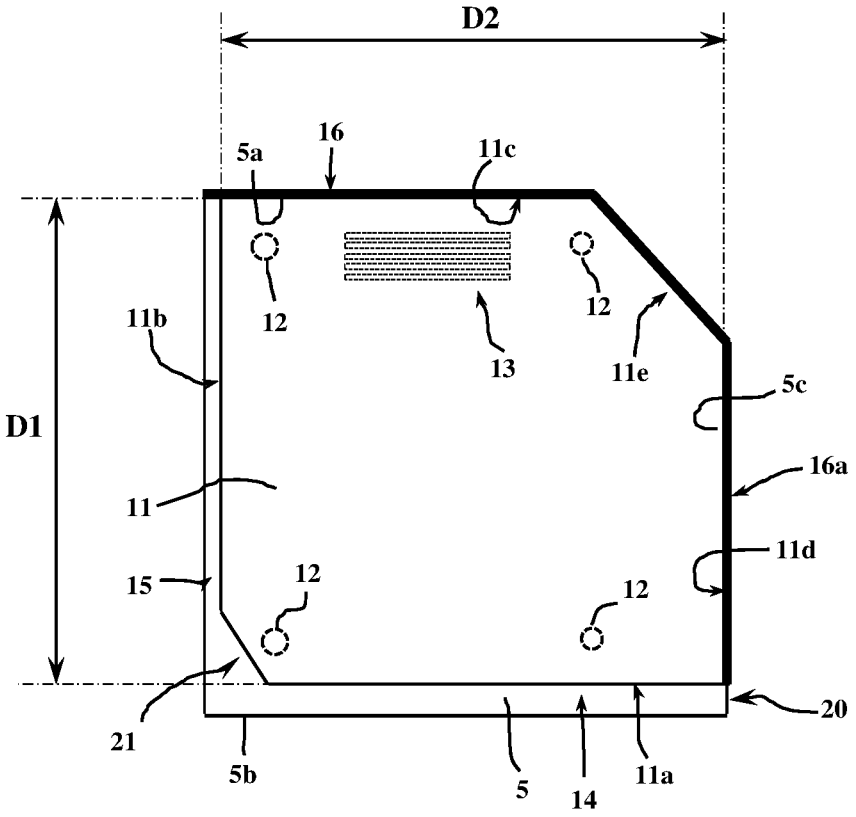
FIG. 4 is a view of the front part of a housing according to a third embodiment.

FIG. 4 shows a third embodiment of the invention, which differs from the first embodiment only by the presence, on the plate 11, of a triangular notch 21 which is provided at a lower corner and which cuts this lower corner.

Here, more particularly the notch 21 is positioned at the left lower corner, located on the opposite side relatively to the slot 20.

This notch 21 makes it possible to create a dissymmetry in the air flow inside the gap 17 separating the plate 11 and the wall 5. This dissymmetry results in a vortex air flow inside the gap 17, thereby facilitating the discharge of grains of sand. The notch 21 could be provided as a curve ensuring the dissymmetry of the lower part of the plate 11. FIG. 4 can be associated with FIG. 2*b*, the sectional view being identical for these two embodiments.

Figure 5:
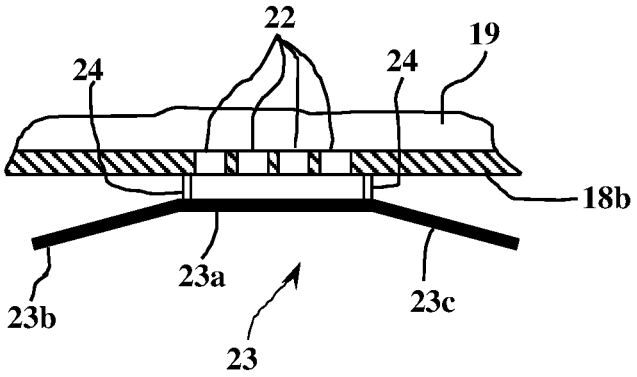
FIG. 5 is a sectional partial view of a lower part of a housing according to an embodiment variant.

FIG. 5 shows, in an enlarged manner and in partial section, the lower part of the box 19 which is visible in FIG. 1*b*. It can be seen that the lower wall 18*b* carries holes 22 allowing water to be discharged outside the box 19.

A panel 23 is arranged below the lower wall 18*b* and at a distance from the holes 22. This panel 23 comprises a median part 23*a* that is parallel to the lower wall 18*b* and is extended by two lateral wings 23*b* and 23*c* gradually moving away with respect to the lower wall 18*b*, from the median part 23*a*.

The panel 23 is attached to the lower wall 18*b* by spacers 24. This gradual profile upstream and downstream of the holes 22 generates, when the vehicle moves, a Venturi effect that facilitates the discharge of grains of sand that would have succeeded to penetrate into the housing 3 despite the inlet plate 11, or during a (actual or simulated) firing phase.

Furthermore, when the vehicle stops, the holes 22 improve the cooling of the interior of the housing 3 by a natural convection effect, fresh air thus entering the housing 3 through the holes 22 and exiting therefrom at the bores of the front 5 and rear 10 walls.

The lateral wings 23*b* and 23*c* of the panel 23 are here planar plate portions forming a constant angle with the lower wall 18*b*. The wings could also be provided as curved plate portions.

The Venturi effect below the box 19 can be obtained in a different manner.

Figure 6:
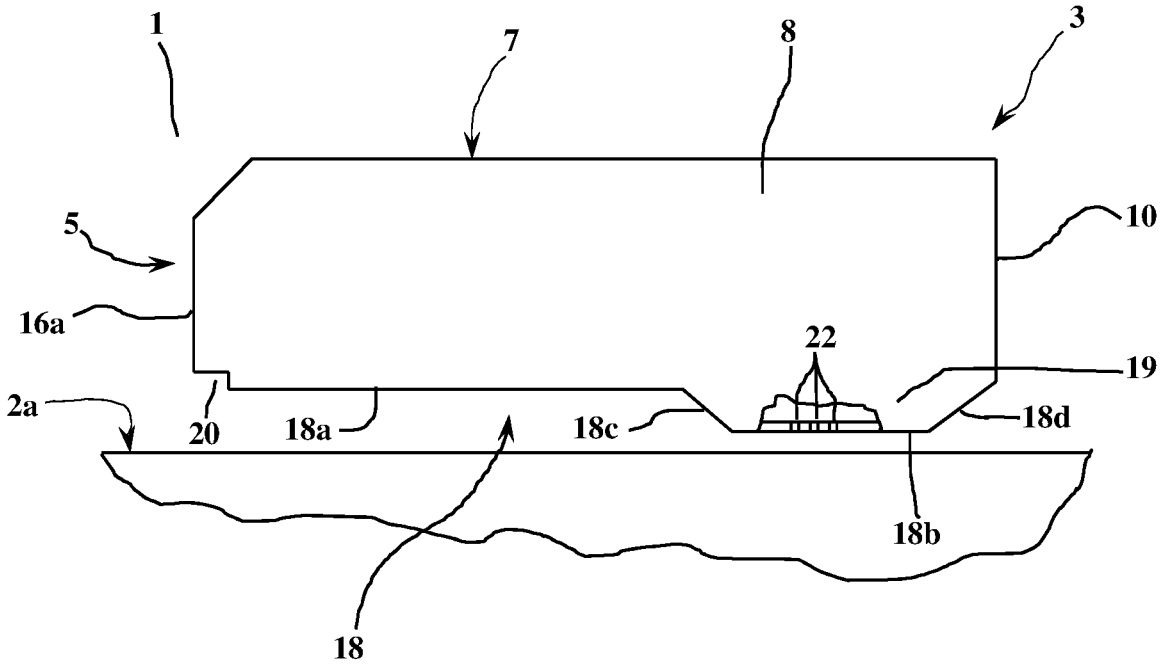
FIG. 6 is a side view of the housing according to another embodiment of the invention.

Thus, FIG. 6 shows, in a similar manner to FIG. 1*b*, a side view of the housing 3. The lower wall 18 of the housing 3 is positioned near the plane 2*a* of the recess 2. The rear part 18*b* of the lower wall 18, which also forms the bottom of the box 19, is delimited by the front connecting plane 18*c* and the rear inclined plane 18*d* which have inclinations substantially symmetrical with respect to a vertical plane.

When the vehicle moves forward, the air is channeled between the plane 2*a* of the recess 2 and the inclined planes 18*c* and 18*d*. The converging and then diverging profile of the air flow section, upstream and downstream of the holes 22, generates the desired Ventury effect when the vehicle moves. Thus, the discharge of grains of sand is facilitated.

Such an arrangement is possible when the housing 3 is located near the plane 2*a* of the recess 2.

Figure 7:
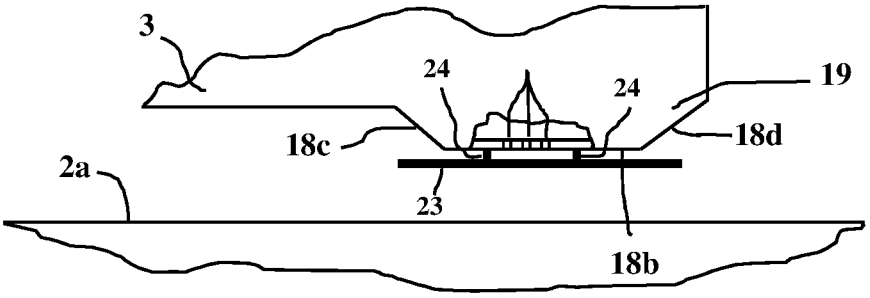
FIG. 7 is a sectional partial view of a lower part of a housing according to another embodiment variant.

FIG. 7 shows another embodiment in which the housing 3 is located at a relatively large distance from the plane 2*a* of the recess 2. A panel 23 is arranged below the lower wall 18*b* and at a distance from the holes 22. The panel 23 is attached to the lower wall 18*b* by spacers 24.

Here, unlike the panel described with reference to FIG. 5, the panel 23 is planar and parallel to the lower wall 18*b*. The panel is longer than the lower wall 18*b*. It cooperates with the inclined planes 18*c* and 18*d* that extend the lower wall 18*b* upstream and downstream so as to form an air flow section which has a profile that is a converging one upstream of the holes 22, and then a diverging one downstream of the holes 22. Again, the desired Venturi effect is generated when the vehicle moves, thereby facilitating the discharge of grains of sand.

The invention claimed is:

1. A housing intended to be arranged on a vehicle and having a substantially parallelepiped shape comprising
- a front wall,
- a rear wall,
- a lower wall,
- an upper wall, and
- two side walls,
- the front and rear walls each comprising at least one bore for allowing air to flow inside the housing, wherein
- at least one of the front or rear walls carries a plate which is arranged outside the housing and at a distance from said wall,
- the at least one bore of the wall in question being located adjacent to an upper edge of said wall,
- the housing further comprising at least one first slot allowing air to pass between the plate and the wall in question,
- the slot being located adjacent to a lower edge of said wall,
- the plate also having at least one second dimension that is less than that of said wall in question such that there is at least one second slot constituted by the gap between a lateral edge of the plate and said wall,
- the housing comprising at least one sheet metal closing the gap between the plate and the wall at an upper edge and at at least one lateral edge of the wall in question.

2. The housing according to claim 1, wherein the at least one first slot is carried by the plate and provided adjacent to a lower edge of the plate.

3. The housing according to claim 1, wherein the plate has at least one first dimension that is less than that of the wall in question such that at least one first slot is constituted by the gap between a lower edge of the plate and said wall.

4. The housing according to claim 1, wherein the sheet metal extends, at least on an edge, beyond the plate so as to constitute a baffle.

5. The housing according to claim 4, wherein the sheet metal does not extend to the lower edge of the wall.

6. The housing according to claim 1, wherein the plate comprises a notch cutting a lower corner so as to create a dissymmetry in the plate.

7. The housing according to claim 1, wherein the plate is an armor steel plate.

8. The housing according to claim 1, wherein the lower wall carries at least one water discharge hole, a panel being arranged below the lower wall and at a distance from the at least one hole, the panel comprising a median part that is parallel to the lower wall and extended by two lateral wings which gradually move away with respect to the lower wall, from the median part.

9. The housing according to claim 1, wherein the lower wall carries at least one water discharge hole intended to be positioned in front of a surface of a recess of the vehicle, the housing comprising at its lower wall inclined planes on either side of the lower wall that carries the holes.

10. The housing according to claim 9, wherein the housing carries a panel arranged below the lower wall and at a distance from the holes, the panel extending below the inclined planes located on either side of the lower wall.

11. A weapon system, wherein it comprises at least one missile launcher arranged in a housing according to claim 1.

* * * * *